US009992584B2

(12) United States Patent
Hillbratt et al.

(10) Patent No.: US 9,992,584 B2
(45) Date of Patent: Jun. 5, 2018

(54) HEARING PROSTHESES FOR SINGLE-SIDED DEAFNESS

(71) Applicant: Cochlear Limited, Macquarie University (AU)

(72) Inventors: Martin Evert Gustaf Hillbratt, Mölnlycke (SE); Marcus Andersson, Mölnlycke (SE)

(73) Assignee: Cochlear Limited, Macquarie University, NSW (AU)

( * ) Notice: Subject to any disclaimer, the term of this patent is extended or adjusted under 35 U.S.C. 154(b) by 10 days.

(21) Appl. No.: 15/009,014

(22) Filed: Jan. 28, 2016

(65) Prior Publication Data

US 2016/0366522 A1 Dec. 15, 2016

Related U.S. Application Data

(60) Provisional application No. 62/172,859, filed on Jun. 9, 2015.

(51) Int. Cl.
*H04R 25/00* (2006.01)

(52) U.S. Cl.
CPC ..... *H04R 25/405* (2013.01); *H04R 25/305* (2013.01); *H04R 25/356* (2013.01); *H04R 25/505* (2013.01); *H04R 25/606* (2013.01); *H04R 25/407* (2013.01); *H04R 2225/41* (2013.01); *H04R 2225/43* (2013.01); *H04R 2225/61* (2013.01); *H04R 2460/13* (2013.01)

(58) Field of Classification Search
CPC .. H04R 25/405; H04R 25/305; H04R 25/356; H04R 25/505; H04R 25/606; H04R 25/407; H04R 2225/41; H04R 2225/43; H04R 2225/61; H04R 2460/13
See application file for complete search history.

(56) References Cited

U.S. PATENT DOCUMENTS

| | | | | |
|---|---|---|---|---|
| 5,680,466 | A * | 10/1997 | Zelikovitz | H04R 25/554 381/309 |
| 8,532,322 | B2 * | 9/2013 | Parker | H04R 25/606 381/151 |
| 2004/0172242 | A1 * | 9/2004 | Seligman | H04R 25/356 704/225 |
| 2011/0026748 | A1 * | 2/2011 | Parker | H04R 25/606 381/326 |

(Continued)

OTHER PUBLICATIONS

"Binaural directionality—Wireless communication opens the door to a completely new approach in directional multi-microphone systems", Phonak Insight, Jul. 2010, 4 pages, downloaded from the internet at https://www.phonakpro.com/content/dam/phonak/b2b/C_M_tools/Library/background_stories/en/Phonak_Insight_StereoZoom210x280_GB_V1.00.pdf.

(Continued)

*Primary Examiner* — Joshua Kaufman
(74) *Attorney, Agent, or Firm* — Edell, Shapiro & Finnan, LLC

(57) ABSTRACT

Presented herein are hearing prostheses configured to execute sound processing (e.g., beamforming techniques) specifically designed to provide better performance for single-side deaf recipients. In particular, the hearing prostheses presented herein execute side-beamforming techniques in which the directionality of the hearing prostheses are limited to a spatial region proximate to the recipient's deaf ear.

19 Claims, 14 Drawing Sheets

(56) References Cited

U.S. PATENT DOCUMENTS

| | | | | |
|---|---|---|---|---|
| 2012/0051548 | A1* | 3/2012 | Visser | G10L 21/0208 381/56 |
| 2012/0239385 | A1* | 9/2012 | Hersbach | G10L 25/84 704/200.1 |
| 2015/0201283 | A1* | 7/2015 | Jeong | H04R 25/305 381/323 |

OTHER PUBLICATIONS

"Phonak, auto ZoomControl", http://www.phonak.com/com/b2c/en/multiused_content/hearing_solutions/hearing_instruments/features/features_quest/auto_zoomcontrol.html, accessed Feb. 9, 2015, seconds 5-13 and seconds 16-19, 13 pages.

* cited by examiner

LEGEND:

| | |
|---|---|
| DEAF EAR | × |
| FUNCTIONAL EAR | ✓ |
| FUNCTIONAL HEARING REGION (BOUNDARY) | - - - - - |
| FRONT FACING REGION (BOUNDARY) | ——— |

LEGEND:

| | |
|---|---|
| DEAF EAR | × |
| FUNCTIONAL EAR | ✓ |
| FUNCTIONAL HEARING REGION (BOUNDARY) | - - - - - |
| OMNIDIRECTIONAL REGION (BOUNDARY) | —·— |

LEGEND:

| | |
|---|---|
| DEAF EAR | × |
| FUNCTIONAL EAR | ✓ |
| FUNCTIONAL HEARING REGION (BOUNDARY) | - - - - - |
| SIDE-BEAMFORMING REGION (BOUNDARY) | ..... |

HEARING PROSTHESES FOR SINGLE-SIDED DEAFNESS

CROSS-REFERENCE TO RELATED APPLICATIONS

This application claims priority to U.S. Provisional Application No. 62/172,859 entitled "Hearing Prostheses for Single-Sided Deafness," filed Jun. 9, 2015, the content of which is hereby incorporated by reference herein.

BACKGROUND

Field of the Invention

The present invention relates generally to sound processing in hearing prostheses.

Related Art

Hearing loss, which may be due to many different causes, is generally of two types, conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Unilateral hearing loss (UHL) or single-sided deafness (SSD) is a specific type of hearing impairment where an individual has one deaf ear and one contralateral functional ear (i.e., one partially deaf, substantially deaf, completely deaf, non-functional and/or absent ear and one functional or substantially functional ear that is at least more functional than the deaf ear). Individuals who suffer from single-sided deafness experience substantial or complete conductive and/or sensorineural hearing loss in their deaf ear.

SUMMARY

In one aspect a method performed at a hearing prosthesis worn by a recipient. The method comprises: monitoring a spatial region proximate to a first ear of the recipient for a sound, wherein the spatial region is a head shadow region of a second ear of the recipient; detecting the sound within the spatial region; and presenting the sound to the recipient via the hearing prosthesis.

In another aspect a method is provided. The method comprises: monitoring a spatial region proximate to a first ear of a recipient using a hearing prosthesis comprising a pair of microphones and a signal processing path, wherein the signal processing path has sensitivity in a spatial region that is complementary to hearing of a second ear of the recipient at selected frequencies; determining whether a sound is present within the spatial region; and when the sound is present in the spatial region, activating one or more side-beamforming audio settings to present the sound to the recipient via the hearing prosthesis.

In another aspect a hearing prosthesis is provided. The hearing prosthesis comprises: two or more microphones configured to detect a sound signal at a first ear of a recipient having a second ear; a sound processor configured to: determine whether the sound signal is detected within a spatial region having an angular width so as to substantially avoid overlap with hearing of the second ear of the recipient at a plurality of frequencies, and when the sound signal is detected within a spatial region, generate stimulation drive signals representative of the sound signal; and a stimulation unit configured to generate, based on the stimulation drive signals, stimulation signals configured to evoke perception of the sound signal at the second ear.

BRIEF DESCRIPTION OF THE DRAWINGS

Embodiments of the present invention are described herein in conjunction with the accompanying drawings, in which.

DETAILED DESCRIPTION

Individuals suffering from single-sided deafness have difficulty hearing conversation on their deaf side, localizing sound, and understanding speech in the presence of background noise, such as in cocktail parties, crowded restaurants, etc. For example, the normal two-sided human auditory system is oriented for the use of specific cues that allow for the localization of sounds, sometimes referred to as "spatial hearing." Spatial hearing is one of the more qualitative features of the auditory system that allows humans to identify both near and distant sounds, as well as sounds that occur three hundred and sixty (360) degrees)(° around the head. However, the presence of one deaf ear and one functional ear, as is the case in single-side deafness, creates confusion within the brain regarding the location of the sound source, thereby resulting in the loss of spatial hearing.

In addition, the "head-shadow effect" causes problems for individuals suffering from single-sided deafness. The head-shadow effect refers to the fact that the deaf ear is in the acoustic shadow of the contralateral functional ear (i.e., on the opposite side of the head). This presents difficulty with speech intelligibility in the presence of background noise, and it is oftentimes the most prevalent when the sound signal source is presented at the deaf ear and the signal has to cross over the head and be heard by the contralateral functional ear.

Figure 1:
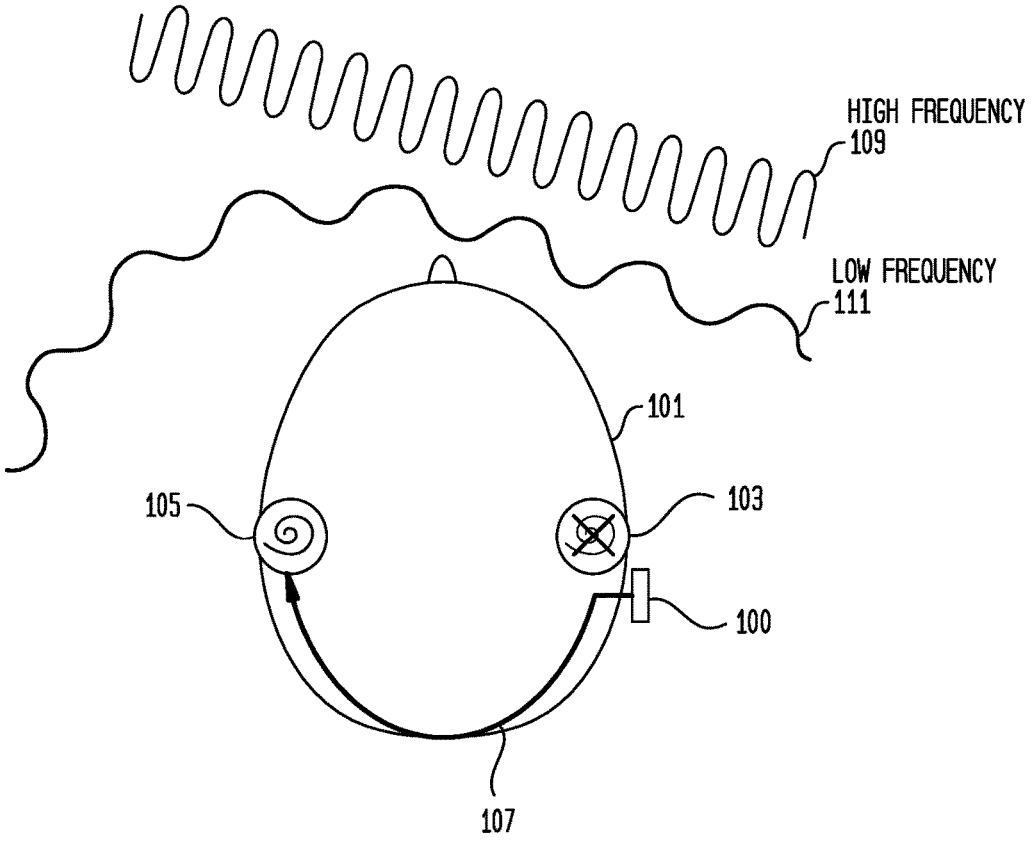
FIG. 1 is a schematic diagram that illustrates the head-shadow effect at the head of an individual suffering from single-sided deafness.

FIG. 1 is a schematic diagram that illustrates the head-shadow effect at the head 101 of an individual suffering from single-sided deafness. As shown, the individual's right ear 103 is deaf (i.e., deaf ear 103) and the contralateral left ear 105 has generally normal audiometric function (i.e., functional ear 105).

FIG. 1 illustrates high frequency sound signals (sounds) 109 and low frequency sounds 111 (with wavelengths not drawn to scale) originating from the deaf side of the head 101 (i.e., the spatial region generally proximate to the deaf ear 103). The low frequency sounds 111, due to their long wavelength, bend readily around the individual's head 101 and, as such, are largely unaffected by the present of the head. That is, the head 101 is more or less transparent to the functional ear 105 with respect to low frequency sounds originating from the individual's deaf side. However, high frequency sounds 109 have shorter wavelengths and, as such, tend to be reflected by the individual's head 101. As a result, the higher frequencies sounds 109 originating from the deaf side are not well received at the functional ear 105, thereby creating audibility and clarity problems. When considering that consonant sounds, which contain much of the meaning of English speech, generally occur in the higher-frequency domain, the head-shadow effect can be the root cause for the difficulty in communication experienced by individuals suffering from single-sided deafness, especially as it relates to speech understanding in the presence of background noise.

In certain examples, frequencies generally above 1.3 kilohertz (kHz) are reflected and are "shadowed" by the recipient's head, while frequencies below 1.3 kHz will bend around the head. Generally speaking, a reason that frequencies below 1.3 kHz are not affected (i.e., bend around the dead) is due to the wave length of such frequencies being in the same order as the width of a normal recipient's head. Therefore, as used herein, "high frequency sounds" or "high frequency sound signals" generally refer to signals having a frequency approximately greater than about 1 kHz to about 1.3 kHz, while "low frequency sounds" or "low frequency sound signals" refer to signals having a frequency approximately less than about 1 kHz to about 1.3 kHz. However, it is to be appreciated that the actual cut-off frequencies may be selected based on a variety of factors, including, but not limited to, the size of a recipient's head.

One treatment for single-sided deafness is the placement of a bone conduction device at an individual's deaf ear. For example, FIG. 1 also schematically illustrates the use of a bone conduction device 100 by the individual suffering from single-sided deafness, sometimes referred to herein as a singled-side deaf recipient or simply recipient. The bone conduction device 100 is located/positioned at the deaf ear 103 and is configured to generate vibrations based on received sound signals. As schematically represented by arrow 107, the vibration generate by the bone conduction device 100 propagates through the recipient's skull bone into the cochlea fluids of the functional ear 105, thereby causing the ear hair cells to move and the perception of the received sound signals. In other words, the bone conduction device 100 allows the recipient to hear sounds from his/her deaf side through the use of the contralateral normal ear 105.

Conventional bone conduction devices are typically configured to primarily detect sound originating from in front of a recipient (i.e., a front direction), while adaptively removing sounds originating from other directions/angles. However, due to the presence of a functional ear, an individual suffering from single-sided deafness does not experience significant problems detecting (i.e., picking up) sounds originating from the front direction. Instead, individuals suffering from single-deafness have significant problems with detecting sounds coming from their deaf-side (especially high frequency signals), which are not perceived by the functional ear due to the head shadow effect.

Figure 2A:
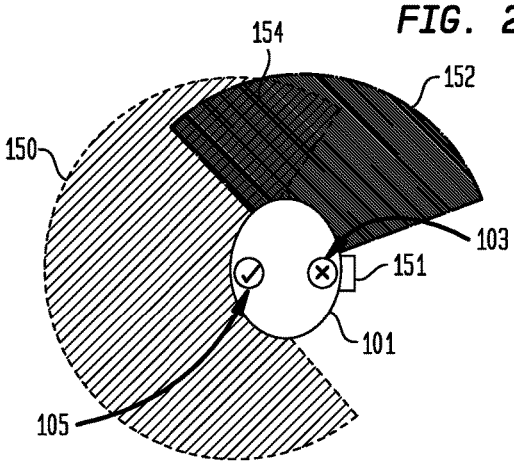
FIG. 2A is a schematic diagram illustrating operation of a conventional bone conduction device.

More specifically, FIG. 2A is a schematic diagram in which a bone conduction device 151 is located at a recipient's deaf ear 103. As shown, the recipient has a contralateral functional ear 105 having a corresponding "functional hearing region" 150. The functional hearing region 150 is a two-dimensional representation of a spatial region in which the functional ear 105 of the recipient is able to detect sounds (i.e., natural sound environment). In FIG. 2A, the bone conduction device 151 has a front facing directionality so as to detect sounds in a "front facing region" 152. In other words, the front facing region 152 is a two-dimensional representation of the spatial region in which the bone conduction device 151 is able to detect sounds.

As is evident in FIG. 2A, the front facing region 152 overlaps with the functional hearing region 150 in front of the recipient. As a result, sounds within this overlapping region 154 will be detected by both the functional ear 105 and the bone conduction device. Since the bone conduction device 151 uses the sounds detected within front facing region 152 to generate movement of the cochlea fluid in functional ear 105, sounds within overlapping region 154 will be presented to the functional ear 105 twice (i.e., once through the normal hearing and once via contralateral vibration). This adds elements of distortion, feedback, noise, etc. to an otherwise clear sound path of the functional ear 105.

Figure 2B:
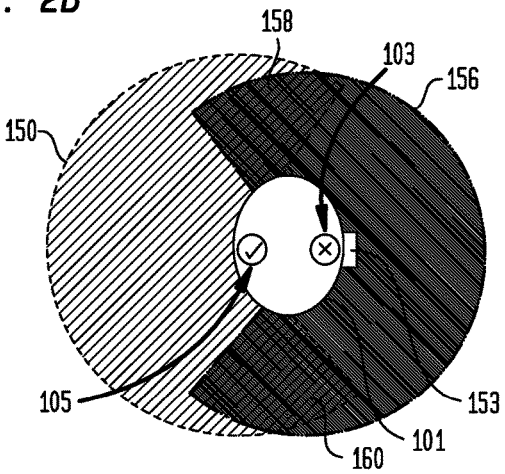
FIG. 2B is a schematic diagram illustrating operation of another conventional bone conduction device.

FIG. 2B is a schematic diagram in which a bone conduction device 153 is located at a recipient's deaf ear 103. The bone conduction device 153 of FIG. 2B is omnidirectional (i.e., no directionality), meaning that the bone conduction device 153 is configured to detect sounds circumferentially around the recipient. However, similar to the functional ear 105, the head shadow effect limits the ability of the bone conduction device 153 to detect sounds at the contralateral side of the recipient's head 101. As such, the omnidirectional bone conduction device 153 detects sounds only within the "omnidirectional region" 156 that generally extends from behind the recipient 101 to in front of the recipient. The omnidirectional region 156 is a two-dimensional representation of the spatial region in which the bone conduction device 153 is able to detect sounds.

As is evident in FIG. 2B, the omnidirectional region 156 overlaps with the functional hearing region 150 both in front of, and behind, the recipient. As a result, sounds within both the front overlapping region 158 and the rear overlapping region 160 will be detected by the functional ear 105 and by the bone conduction device 153. Since the bone conduction device 153 uses the sounds detected within the omnidirectional region 156 to generate movement of the cochlea fluid in functional ear 105, sounds within front overlapping region 158 and the rear overlapping region 160 will be presented to the functional ear 105 twice (i.e., once through the normal hearing and once via contralateral vibration). Again, this adds elements of distortion, feedback, noise, etc. to an otherwise clear sound path of the functional ear 105.

As can be seen in FIGS. 2A and 2B, conventional bone conduction devices are not suited for use by single-sided deaf recipients. As such, presented herein are bone conduction devices that are specifically configured for use by single-sided deaf recipients. In particular, bone conduction devices in accordance with the embodiments presented herein execute side-beamforming techniques in which the directionality of the bone conduction device is limited to a spatial region proximate to the recipient's deaf ear. In certain embodiments, the spatial region corresponds to a head shadow region that affects the contralateral functional ear. Additionally or alternatively, the directionality of the bone conduction device is selected so as to detect sounds within a spatial region that does not substantively overlap with the recipient's contralateral (functional) hearing at certain frequencies (i.e., a directionality pattern of the bone conduction device has an angular width so as to substantially avoid overlap with hearing of the contralateral functional ear of the recipient high frequencies). Such arrangements, when used by a single-sided deaf recipient, the bone conduction devices presented herein substantially reduce and/or eliminate the negative effects on the function hearing of the recipient that are present in conventional devices.

Figure 2C:
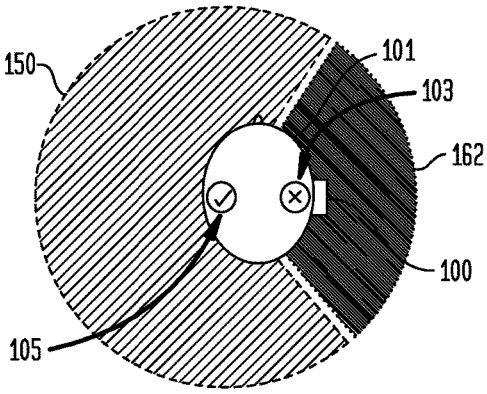
FIG. 2C is a schematic diagram illustrating operation of a bone conduction device in accordance with embodiments presented herein.

FIG. 2C is a schematic diagram illustrating the side-beamforming directionality of the bone conduction device 100 in accordance with embodiments presented herein. As shown, the bone conduction device 100 is configured to detect sounds within a "side-beamforming region" 162 that does not overlap with the functional hearing region 150 described above with reference to FIGS. 2A and 2B. The side-beamforming region 162 is a two-dimensional representation of the spatial region in which the bone conduction device 100 is able to detect sounds.

In the embodiment of FIG. 2C, the bone conduction device 100 is configured to primarily detect sounds received within an angular spatial region that is centered at approximately one hundred and eighty (180) degrees from the contralateral ear (i.e., ninety degrees from the front of the recipient) and has an angular width of approximately ninety degrees (±45° in the front and rear directions) where the functional ear 105 of the single-sided deaf recipient 101 has difficulty detecting sounds. As described further below, in another embodiment the bone conduction device 100 is configured to detect sounds from angular region directed at direction of 150°±40°, with reference to the contralateral functional ear. In general, the bone conduction device 100 is configured to detect sounds within a spatial region that does not significantly overlap with the recipient's contralateral functional hearing. As such, the bone conduction device 100 is sometimes referred to herein as having sensitivity in a spatial region that is "complimentary to" (i.e., assists/supports and generally does not interfere with) the hearing of the functional contralateral ear of the recipient at selected frequencies.

In accordance with embodiments presented herein, the bone conduction device 100 is configured to execute sound processing (e.g., beamforming techniques) specifically designed to provide better performance for single-side deaf recipients. More specifically, bone conduction device 100 emphasizes sounds originating from the deaf side of the recipient and de-emphasizes/removes sounds originating from other directions.

A number of different hearing prostheses (e.g., bone conduction devices, hearing aids, etc.) may be selected for use in treating single-sided deafness. Merely for ease of illustration, the techniques presented herein are primarily described with reference to the use of bone conduction devices to treat recipient's suffering from single-sided deafness. It is to be appreciated that the techniques presented herein may also be used in a variety of different hearing prostheses.

Figure 3:
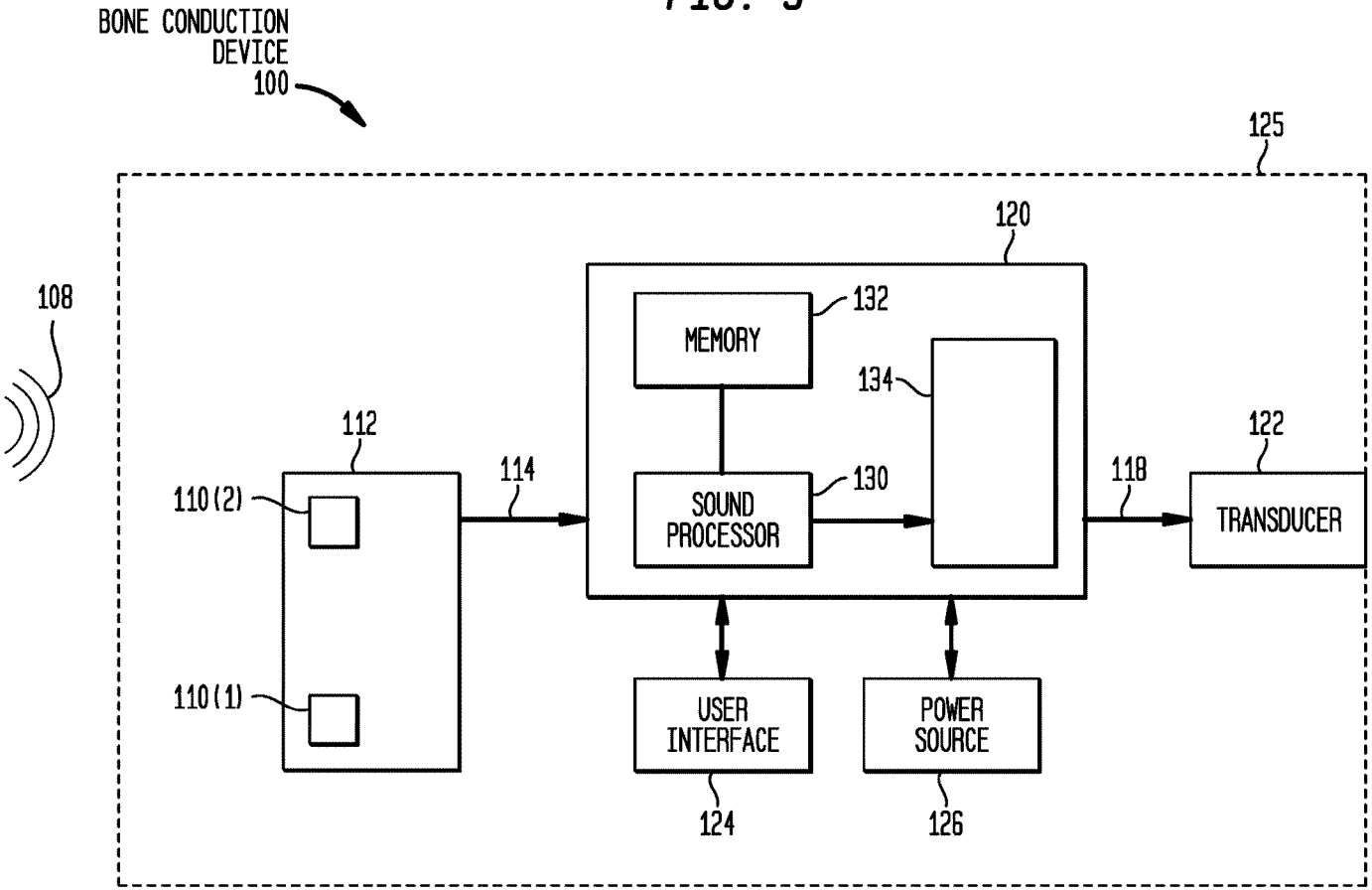
FIG. 3 is a functional block diagram of a bone conduction device in accordance with an embodiment presented herein.

FIG. 3 is a functional block diagram of one example arrangement for a bone conduction device, such as bone conduction device 100, in accordance with embodiments presented herein. As shown, bone conduction device 100 is positioned at (e.g., behind) the recipient's deaf ear 103. The bone conduction device 100 comprises a sound input module 112, an electronics module 120, a transducer 122, a user interface 124, and a power source 126.

The sound input module 112 is configured to convert a received acoustic sound signal (sound) 108 into one or more electrical signals 114. The sound input module 112 comprises at least two microphones 110(1) and 110(2) that are configured to receive the sound 108. The sound input module 112 may include other sound input elements (e.g., ports, telecoils, etc.) that, for ease of illustration, have been omitted from FIG. 3.

The electrical signal(s) 114 generated by sound input module 112 are provided to electronics module 120. In general, electronics module 120 is configured to convert the electrical signal(s) 114 into one or more transducer drive signals 118 that active transducer 122. More specifically, electronics module 120 includes, among other elements, a sound processor 130, a memory 132, and transducer drive components 134.

The sound processor 130, possibly in combination with one or more components in the sound input module 112, forms a sound processing path for the bone conduction device 100. The sound processor 130 may be a hardware processor that executes one or more software modules (e.g., stored in memory 132) or implemented with digital logic gates in one or more application-specific integrated circuits (ASICs). That is, the sound processing path may be implemented in hardware, software, or a combination of hardware and software.

Transducer 122 illustrates an example of a stimulation unit that receives the transducer drive signal(s) 118 and generates vibrations for delivery to the skull of the recipient via a transcutaneous or percutaneous anchor system (not shown) that is coupled to bone conduction device 100. Delivery of the vibration causes motion of the cochlea fluid in the recipient's contralateral functional ear, thereby activating the hair cells in the functional ear.

FIG. 3 also illustrates the power source 126 that provides electrical power to one or more components of bone conduction device 100. Power source 126 may comprise, for example, one or more batteries. For ease of illustration, power source 126 has been shown connected only to user interface 124 and electronics module 120. However, it should be appreciated that power source 126 may be used to supply power to any electrically powered circuits/components of bone conduction device 100.

User interface 124 allows the recipient to interact with bone conduction device 100. For example, user interface 124 may allow the recipient to adjust the volume, alter the speech processing strategies, power on/off the device, etc. Although not shown in FIG. 3, bone conduction device 100 may further include an external interface that may be used to connect electronics module 120 to an external device, such as a fitting system.

In the example of FIG. 3, sound input module 112, electronics module 120, transducer 122, user interface 124, and power source 126 have been shown as integrated in a single housing 125. However, it should be appreciated that in certain examples, one or more of the illustrated components may be housed in separate or different housings. Similarly, it should also be appreciated that in such embodiments, direct connections between the various modules and devices are not necessary and that the components may communicate, for example, via wireless connections.

Figure 4A:
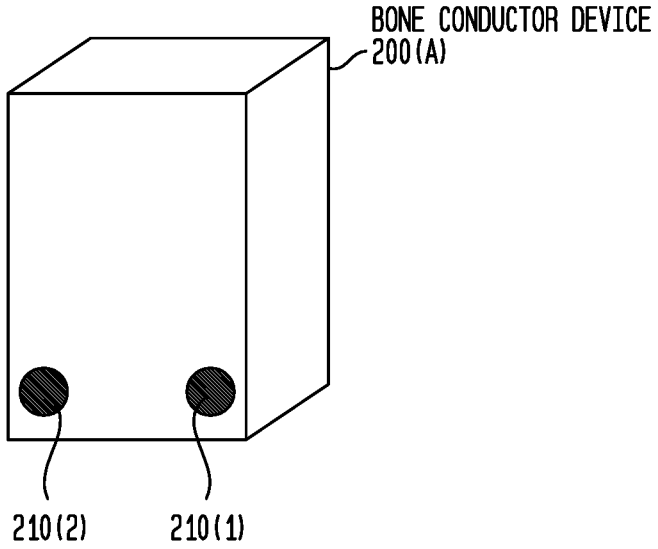
FIGS. 4A-4D are schematic diagrams illustrating microphone arrangements for bone conduction devices in accordance with embodiments presented herein.

The side-beamforming techniques in accordance with embodiments presented herein may make use of different microphone arrangements, several of which are shown in FIGS. 4A-4D. More specifically, FIG. 4A is a simplified perspective view of a bone conduction device 200(A) having two microphones 210(1) and 210(2) in a forward/rear arrangement. That is, when the bone conduction device 200(A) is worn by a recipient, a first microphone (e.g., microphone 210(1)) is positioned and/or directed towards the front of the recipient, while the second microphone (e.g., microphone 210(2)) is positioned and/or directed towards the back of the recipient.

Figure 4B:
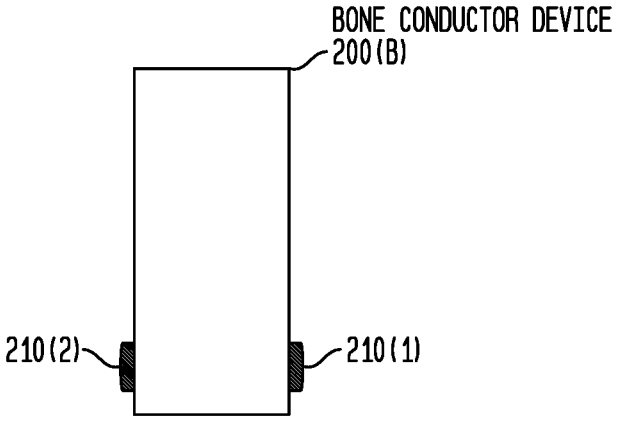

FIG. 4B is a front view of another bone conduction device 200(B) having two microphones 210(1) and 210(2) in a left/right arrangement. That is, when the bone conduction device 200(B) is worn by a recipient, a first microphone (e.g., microphone 210(1)) is positioned and/or directed towards the side of the recipient's head, while the second microphone (e.g., microphone 210(2)) is positioned and/or directed outwards from the side of the recipient's head.

Figure 4C:
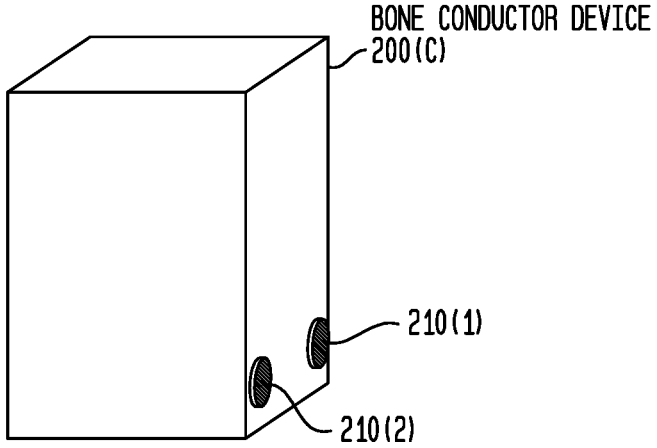

FIG. 4C a perspective view of another bone conduction device 200(C) having two microphones 210(1) and 210(2) in a dual-forward arrangement. That is, the microphones 210(1) and 210(2) are positioned side-by-by such that, when the bone conduction device 200(C) is worn by a recipient, both microphones are positioned and/or directed towards the front of the recipient.

Figure 4D:
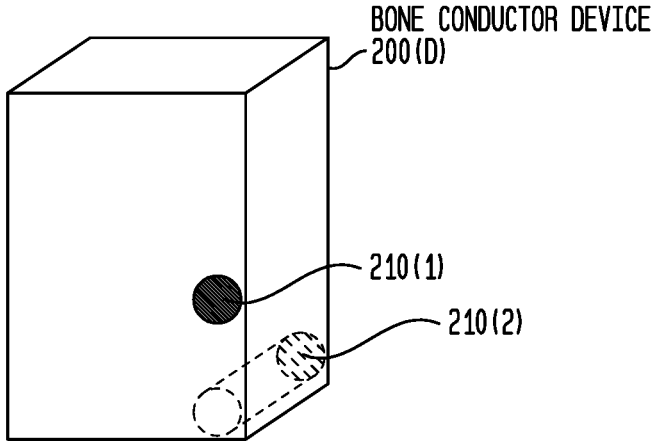

FIG. 4D is a perspective view of another bone conduction device 200(D) having two microphones 210(1) and 210(2). In this embodiment, when the bone conduction device 200(D) is worn by a recipient, a first microphone (e.g., microphone 210(1)) is positioned and/or directed outwards from the side of the recipient's head. The second microphone (e.g., microphone 210(2)) is also directed outwards from the side of the recipient's head, but is located at the bottom of a tube so that sounds reach the second microphone with a delay relative to when sounds are detected at the first microphone.

FIGS. 4A-4D include simplified representations of the bone conduction devices 200(A)-200(D) (i.e., a square box device). It is to be appreciated that the side-beamforming techniques presented herein could be implemented with bone conduction devices having various shapes and arrangements, such as behind-the-ear devices, button devices, etc.

The various microphone arrangements shown in FIGS. 4A-4D are illustrative and it is to be appreciated that the side-beamforming techniques in accordance with embodiments presented herein may make use of any of the above or other microphone arrangements. For example, embodiments may use an array of three or more microphones with different locations and/or parameters (e.g., a third microphone placed with a tube in the ear canal or an in the device). For ease of illustration, embodiments are primarily described herein with reference to a bone conduction device having microphones in the forward/rear arrangement of FIG. 4A (i.e., a front-facing microphone and a rear-facing microphone).

Figure 5:
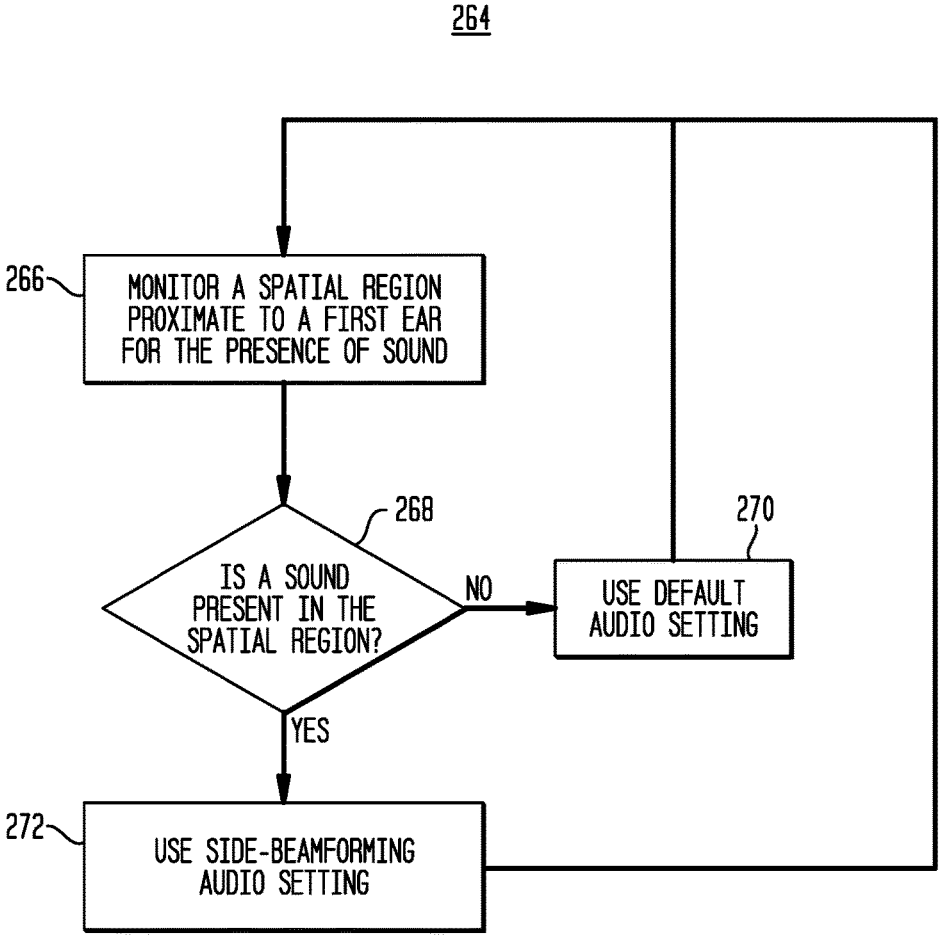
FIG. 5 is a flowchart of a method in accordance with embodiments presented herein.

FIG. 5 is a flowchart of a method 264 in accordance with embodiments presented herein. For ease of illustration, the embodiment of FIG. 5 will be described with reference to the bone conduction device 100 of FIG. 3 in which the microphones 110(1) and 110(2) are in a forward/rear arrangement. The bone conduction device 100 is positioned at a first ear (e.g., deaf ear 103) of the recipient's head 101.

Method 264 begins at 266 where the bone conduction device 100, which is configured for use by a recipient suffering from single-sided deafness (e.g., a recipient having a sensorineural deaf ear and a contralateral functional ear), monitors a spatial region for the presence of a sound within the spatial region. The specific spatial region that is monitored for the presence of a sound may vary in accordance with embodiments presented herein. In one example, the monitored spatial region is a head shadow region affecting the recipient's second ear (e.g., contralateral functional ear 105). That is, the monitored spatial region may be a spatial region in which the contralateral functional ear 105 is unable to detect sounds due, at least in part, to the "shadow" created by the recipient's head. In certain embodiments, the monitored spatial region is a region that is "complementary to" the hearing of the contralateral functional ear (i.e., a region that does not significantly overlap with the hearing of the contralateral functional ear).

In one example, the monitored spatial region is a region that is "complementary to" the hearing of the contralateral functional ear and that is between one hundred and twenty (120) degrees and two hundred and forty (240) degrees from the contralateral functional ear.

Returning to the example of FIG. 5, at 268 a determination is made as to whether a sound has been detected in the spatial region. If a sound is not detected in the spatial region, then at 270 the bone conduction device may operate in accordance with a default audio setting. Since the bone conduction 100 is used by a single-sided deaf recipient with functional hearing, in certain embodiments the default audio setting used when a sound is not detected in the spatial region is a setting that prevents/precludes delivery of vibrations to the recipient. That is, a default audio setting for the bone conduction device 100 may be to "drop" sounds determined to be outside of the spatial region, since such sounds may already be detected and presented to the recipient 101 by the functional ear 105.

If, at 268, the bone conduction device 100 determines that a sound is present in the spatial region, then at 272 the bone conduction device operates in accordance with one or more side-beamforming audio settings. In general, the side-beamforming settings cause the bone conduction device 100 to utilize the sound detected within the spatial region to generate vibrations that are delivered to the contralateral function ear 105. As a result, the recipient is able to perceive sounds that originate from all directions, including the head shadow region affecting the functional ear 105.

The side-beamforming audio settings in accordance with embodiments presented herein may take different forms. For example, as detailed above, the primary need for bone conduction device 100 is to compensate for sounds missing due to the head shadow effect. This means that, in general, there is little need to amplify sounds originating from in front of or behind the recipient. Instead, the recipient benefits most from amplification of sounds coming from the deaf side. Therefore, in one implementation, the side-beamforming audio settings may cause the bone conduction device 100 to apply a gain to, or amplify, only the sounds detected within the spatial region. In another implementation, the bone conduction device 100 operates to estimate the signal-to-noise ratio (SNR) of sounds detected with the spatial region. The SNR estimate can be used to determine if the sounds are, for example, selected/desired sounds (e.g., speech) or simply noise. The bone conduction device 100 could then use the SNR estimate of the detected sounds to determine how the sounds should be presented to recipient, if at all, as vibrations. For example, if the SNR estimate indicates that the detected sounds are speech, the bone conduction device 100 can apply a gain to (i.e., amplify) the sounds and/or portions of the sounds. If the SNR estimate indicates that the detected sounds are noise, the bone conduction device 100 may de-emphasize or drop the sounds or noisy portions of the sounds (e.g., amplification is increased when a useful sounds are detected, and amplification is decreased when useful sounds are not detected). In one embodiment, the bone conduction device 100 estimates the SNR of a sound detected in the spatial region and only presents the sound when the SNR estimate is greater than a threshold. In another embodiment, the angular width of the spatial region that is monitored by the bone conduction device 100 is selected/adjusted.

Furthermore, also as noted above, high frequency sounds have shorter wavelengths and, as such, tend to be reflected by a recipient's head. In contrast, the longer wavelengths of low frequency sounds enable those sounds to bend around a recipient's head. As such, a functional ear of a single-sided deaf recipient has a greater difficulty in detecting high frequency sounds originating from the recipient's deaf side than lower frequency sounds originating from the recipient's deaf side. Therefore, in certain embodiments, the bone conduction device 100 may be configured to process and/or apply a gain to only sounds within a specific higher frequency range. In other words, the bone conduction device 100 may de-emphasize or drop lower frequency sounds, thereby allowing the functional ear 105 to detect and present these lower frequency sounds without interference from the bone conduction device. In one specific arrangement, the bone conduction device 100 includes a high pass filter to remove lower frequency sounds. The high pass filter may have a cutoff frequency of approximately 1 kHz to ensure the capture of primary information.

In a further embodiment of the side-beamforming audio settings, amplification of the bone conduction device 100 is dependent on the input level of the detected sounds in an inverted relationship to that used in traditional sound processing. As noted, when most of the speech comes from the recipient's front, is diffused, or is coming from the functional side, there is no need to activate the bone conduction device 100. However, when the loudness (input level) of detected sounds is sufficiently high (indicating that the sounds are originating from the deaf side), then the bone conduction device 100 is activated. In general, the stronger the input level of detected sounds, the more amplification that is applied, until an upper threshold is reached.

In accordance with examples presented herein, directivity is applied to sounds louder than about approximately 60 dB SPL (i.e., a threshold level of 60 dB SPL before application of the side-beamforming audio settings). In other words, when the device detects speech or other sound signals louder than about 60 dB SPL (+−10 dB), the bone conduction device 100 is activated. In certain examples, the threshold level may also be frequency dependent. When a frequency dependent threshold level is applied, less sensitivity is used for the lowest frequencies so as to avoid overlap with the functional hearing. It can also be considered to turn the bone conduction device 100 on when signals below a threshold (e.g., weak signals such as whisper) are detected.

In one embodiment, the SNR of the signal is estimated in combination with the loudness level (e.g., amplitude). In such examples, the bone conduction device 100 is only activated if the SNR is at an acceptable level and the loudness is above a specific threshold.

In certain examples, the bone conduction device 100 can be placed in standby or low-power mode when the input levels of sounds are below a specific threshold. That is, the bone conduction device 100 is configured to automatically recognize when the device is not needed/useful and will enter a lower power state until activated in response to the detection of sounds in the spatial region. Such an arrangement may be possible, for example, if a low resolution signal processor has general purpose input/output (GPIO) ports with a lower sample rate which could be used as an input to sense input levels of received sounds. Such embodiments may also be combined with, for example, modulation speed, SNR, or other techniques to determine if a sound could be useful when presented using the bone conduction device 100.

It can also be considered that there is a single-sided deafness classification that activates the side-beamforming only in selected sound environments (e.g., when in a cocktail party/restaurant, etc.). That is, the monitoring of a spatial region proximate to the deaf ear may only occur in certain sound environments.

Returning the specific example of FIG. 5, the method 264 returns to step 266 after step 270 or step 272. However, it is to be appreciated that the operations of steps 266, 268, 270, and 272 may be continuous and/or overlapping. For example, the bone conduction device 100 may continuously monitor the spatial region while the bone conduction device is simultaneously determining whether sounds are present in the spatial region. In one example, the monitoring of the spatial region at step 266 is performed by microphones 110(1) and 110(2), and the determining of whether sounds are present at step 268 is performed by sound processor 130. Further details of techniques that may be used by the sound processor 130 to determine whether sounds are present in the spatial region are provided below.

Figure 6A:
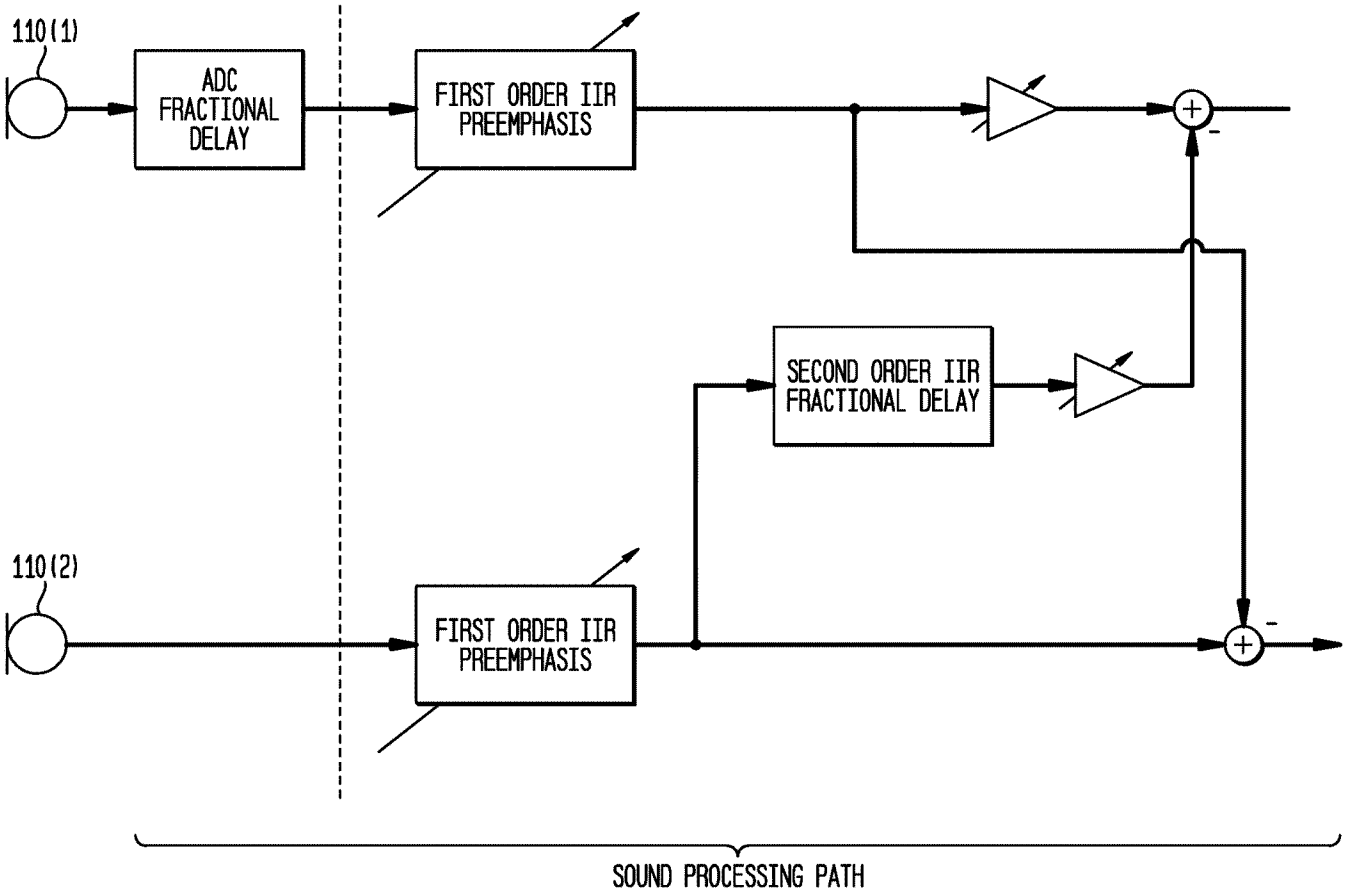
FIG. 6A is a schematic diagram illustrating a sound processing path for a bone conduction device in accordance with embodiments presented herein.
Figure 6B:
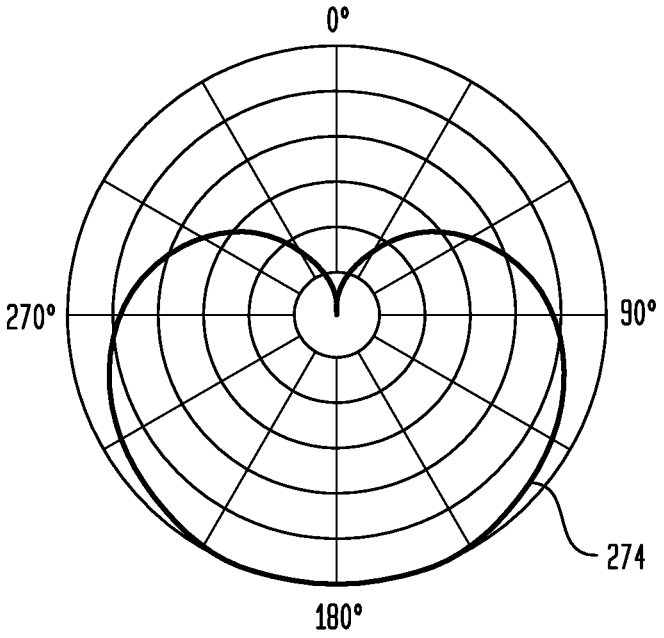
FIGS. 6B and 6C are plots illustrating cardioids generated from microphone signals in accordance with embodiments presented herein.
Figure 6C:
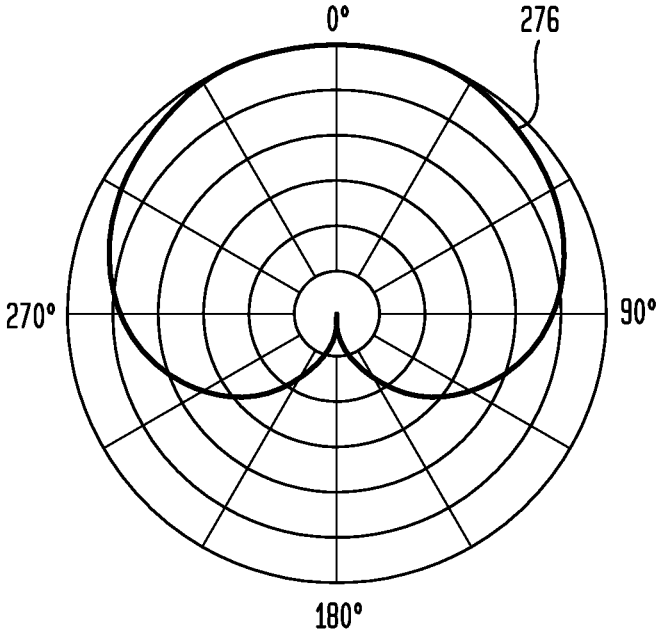

FIG. 6A illustrates an arrangement for portion of a sound processing path for bone conduction device 100 in accordance with an embodiment presented herein. More specifically, FIG. 6A illustrates an arrangement in which signals from the front facing microphone 110(1) and the rear facing microphone 110(2) are utilized to generate a back facing cardioid pattern/signal (back cardioid) 274 that is shown in FIG. 6B, and a front facing cardioid pattern/signal (front cardioid) 276 that is shown in FIG. 6C. The microphones 110(1) and 110(2) are omnidirectional microphones. Therefore, as represented in FIG. 6A, a delay (e.g., analog-to-digital (ADC) fractional delay) is added to one of the microphone signals and the delayed microphone signal is added to the other microphone signal, and vice versa, to generate the cardioid patterns of FIGS. 6B and 6C. Although FIG. 6A illustrates an implementation that uses omnidirectional microphones, it is to be appreciated that the techniques presented herein may alternatively use cardioid microphones (i.e., microphones have a cardioid pick-up pattern).

Figure 6D:
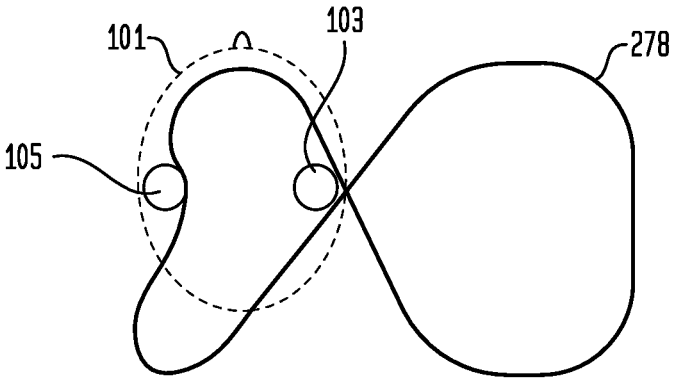
FIG. 6D is a plot of an example side-beamforming cardioid in accordance with the embodiment of FIG. 6A.

In one embodiment presented herein, the front cardioid 276 is convolved with the rear cardioid 274 in the time domain. This convolution results, in essence, in the filtering of the front cardioid 276 by the content of the rear cardioid 274 such that only signals existing in both cardioids will remain as part of the final/resulting signal. This results in the side-beamforming cardioid 278 as shown in FIG. 6D that is generally complementary to the functional hearing of ear 105.

In other words, the bone conduction device 100 is configured with a sensitivity in a spatial region that corresponds to the side-beamforming cardioid pattern 278. If sounds are detected within the spatial region, the bone conduction device 100 actives one or more of the side-beamforming audio settings described above. For reference, the side-beamforming cardioid pattern 278 is shown in FIG. 6D overlaying an outline of the recipient's head 101. FIG. 6D illustrates that the side-beamforming cardioid pattern 278 primarily detects sounds originating from the deaf-side of the recipient.

FIGS. 6A-6D illustrate one technique for determining whether sounds are present in the spatial region. In an alternative embodiment, rather than convolving the front cardioid 276 with the rear cardioid 274, the cross correlation between the front and rear cardioids is calculated. The calculated cross correlation is then used as the sound signal. In another embodiment, the cross spectral density spectra, which corresponds to the performance of a Fast Fourier Transform (FFT) of the similarities between a front and rear microphone signal, is determined. The signal to keep can be identified in the frequency domain to which other processing, such as wide dynamic range compression (WDRC), noise reduction, etc. can be applied. In such examples, the addition of the delay is not needed in order to calculate front and rear cardioids.

Figure 7A:
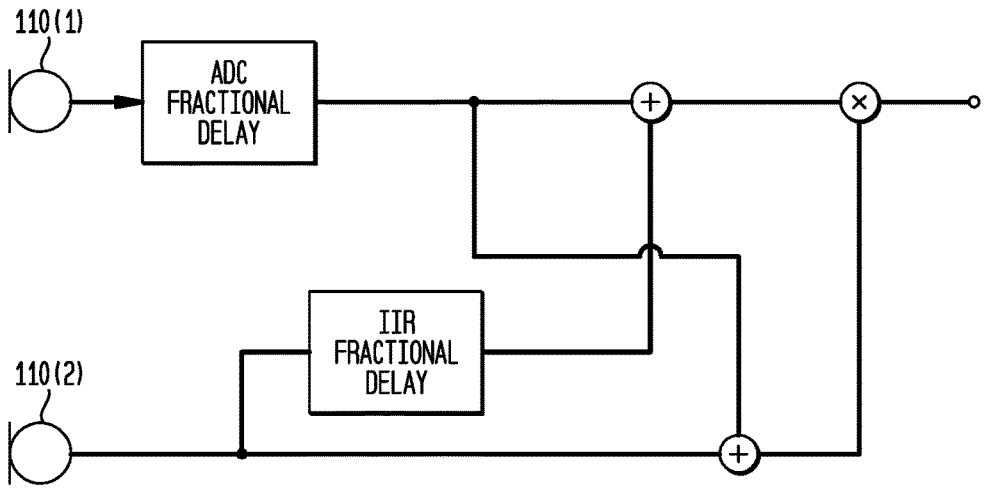
FIGS. 7A and 7B are schematic diagrams illustrating additional sound processing paths for bone conduction devices in accordance with embodiments presented herein.
Figure 7B:
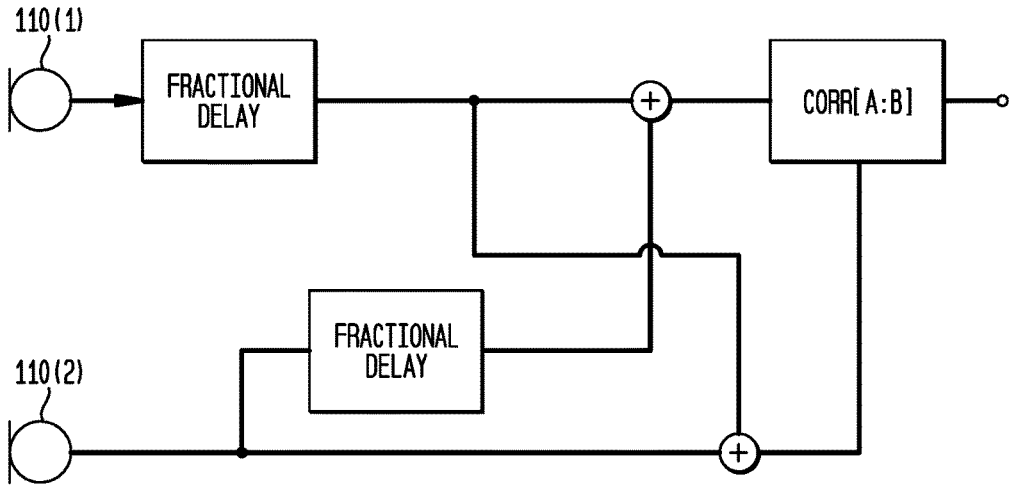

FIGS. 7A and 7B each illustrate further arrangements for the portion of the sound processing path of sound processor 130. More specifically, FIGS. 7A and 7B illustrate alternative arrangements to achieve a side-beamforming directionality while the microphones are in a front and back position (FIGS. 4A and 4B). In the example of FIG. 7A, the contributions from the calculated frontal facing cardioid and the calculated rear facing cardioid are added together. This may provide a signal gain of about 6 dB towards the side of the head.

FIG. 7B illustrates a variant of the arrangement of FIG. 7A where only the signals which can be found in both the front and rear facing calculated cardioids are retained. The arrangement of FIG. 7B may provide a gain benefit of about 6-15 dB towards the side of the head.

In addition to arrangement of FIG. 7B, an iterative/adaptive LMS process can also be applied to make a better estimation of the correlated signals in the arrangement of FIG. 7B. Such operations can also limit audible artefacts created by the arrangement of FIG. 7B since this will provide a better estimation over time of which portions of the signal to maintain and remove.

Figure 8A:
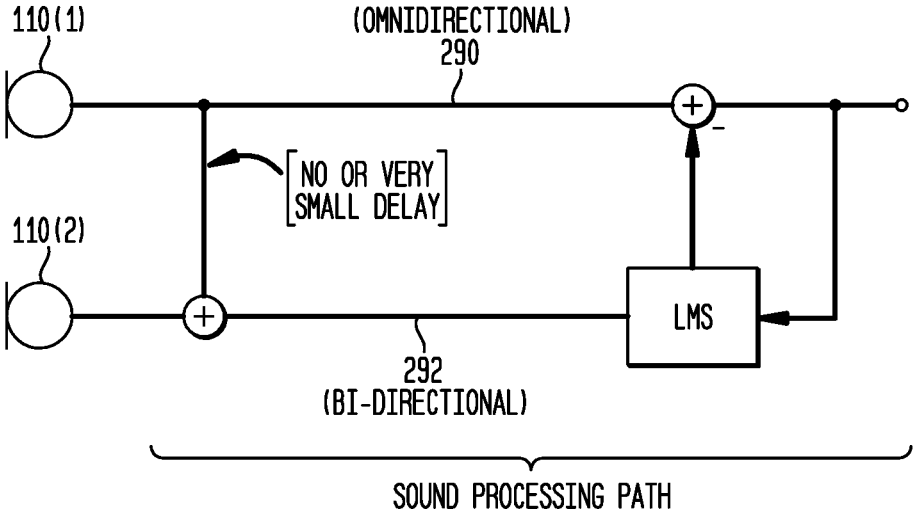
FIG. 8A is a schematic diagram illustrating another sound processing path for a bone conduction device in accordance with embodiments presented herein.
Figure 8B:
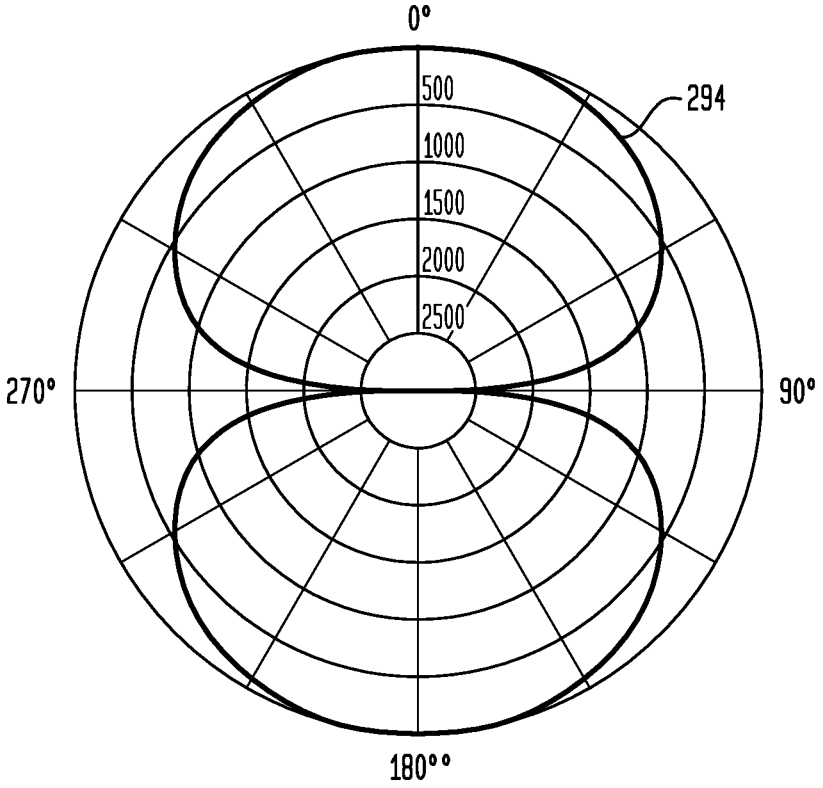
FIG. 8B is a plot of a bi-directional cardioid generated from microphone signals in accordance with embodiments presented herein.

FIG. 8A illustrates an example sound processing path in which an adaptive system is used to remove signals originating from the front and rear of a recipient, while retaining the signals originating from the deaf side. As shown in FIG. 8A, the omnidirectional signal from microphone 110(1) is retained at the first signal path 290 and is added to the rear microphone signal with no or a very low delay, creating a "FIG. 8" or "bi-directional" signal at the second signal path 292. An example bi-directional cardioid pattern/signal 294 is shown in FIG. 8B, but the exact shape may also depend on frequency. A low or high pass filter may be applied to signal at the second signal path 292 before application of a least mean squares (LMS) process. The LMS is used to determine an optimal filter that removes the contribution of any signal in the bi-directional cardioid pattern 294 and the second signal from the omnidirectional signal at line 290. The remainder is only the signal components that originate at an angle of from approximately 180° degrees from the contra lateral functional ear.

Figure 9A:
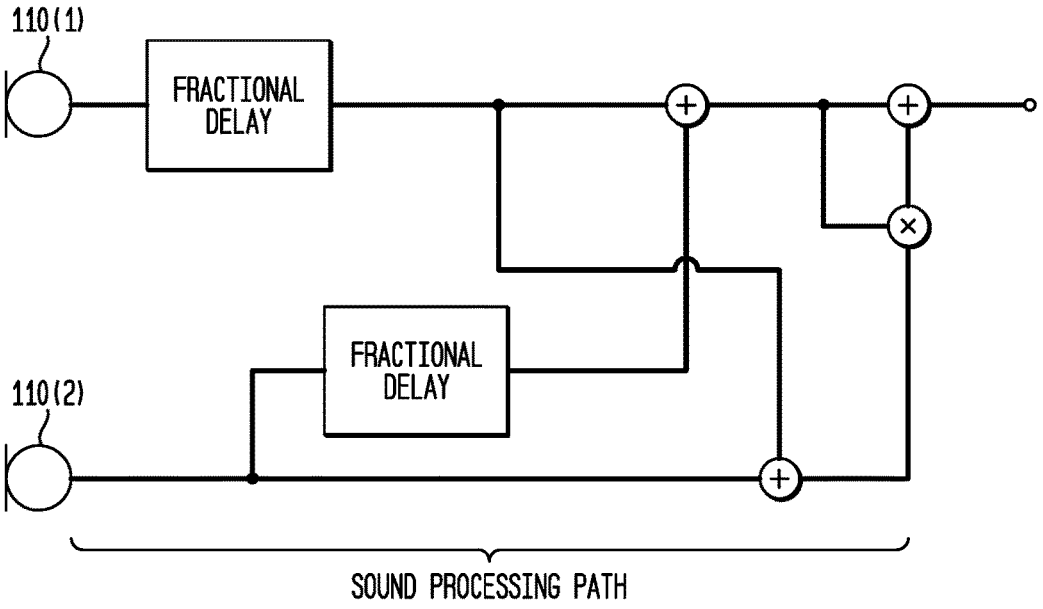
FIG. 9A is a schematic diagram illustrating another sound processing path for a bone conduction device in accordance with embodiments presented herein.
Figure 9B:
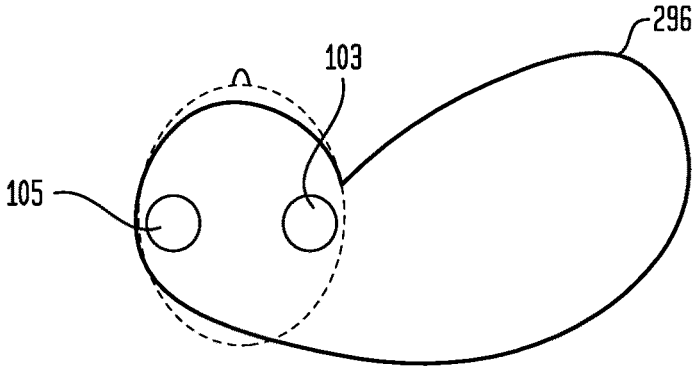
FIG. 9B is a plot of an example side-beamforming cardioid in accordance with the embodiments of FIG. 9A.

FIG. 9A illustrates another example sound processing path that may be used in accordance with embodiments presented herein. The sound processing path of FIG. 9A has a sensitivity in a spatial region that corresponds to the side-beamforming cardioid pattern/signal 296 shown in FIG. 9B. For reference, the cardioid pattern 296 is shown in FIG. 9B overlaying an outline of the recipient's head 101 and with the effects of the head shadow. FIG. 9B illustrates that the cardioid pattern 296 primarily is oriented for maximum detection of sounds originating at approximately 150° degrees from the contra lateral functional ear.

Figure 10A:
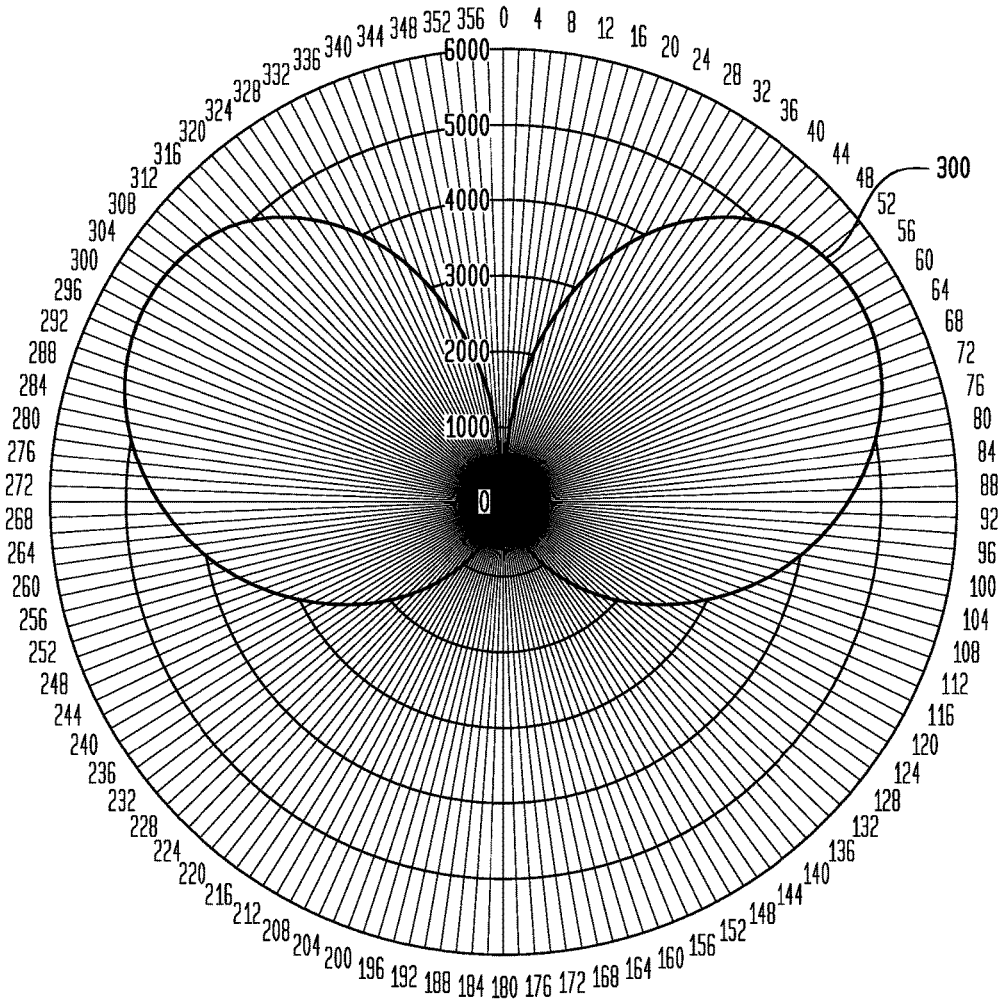
FIGS. 10A and 10B are free-field plots of example side-beamforming cardioids in accordance with embodiments presented herein.
Figure 10B:
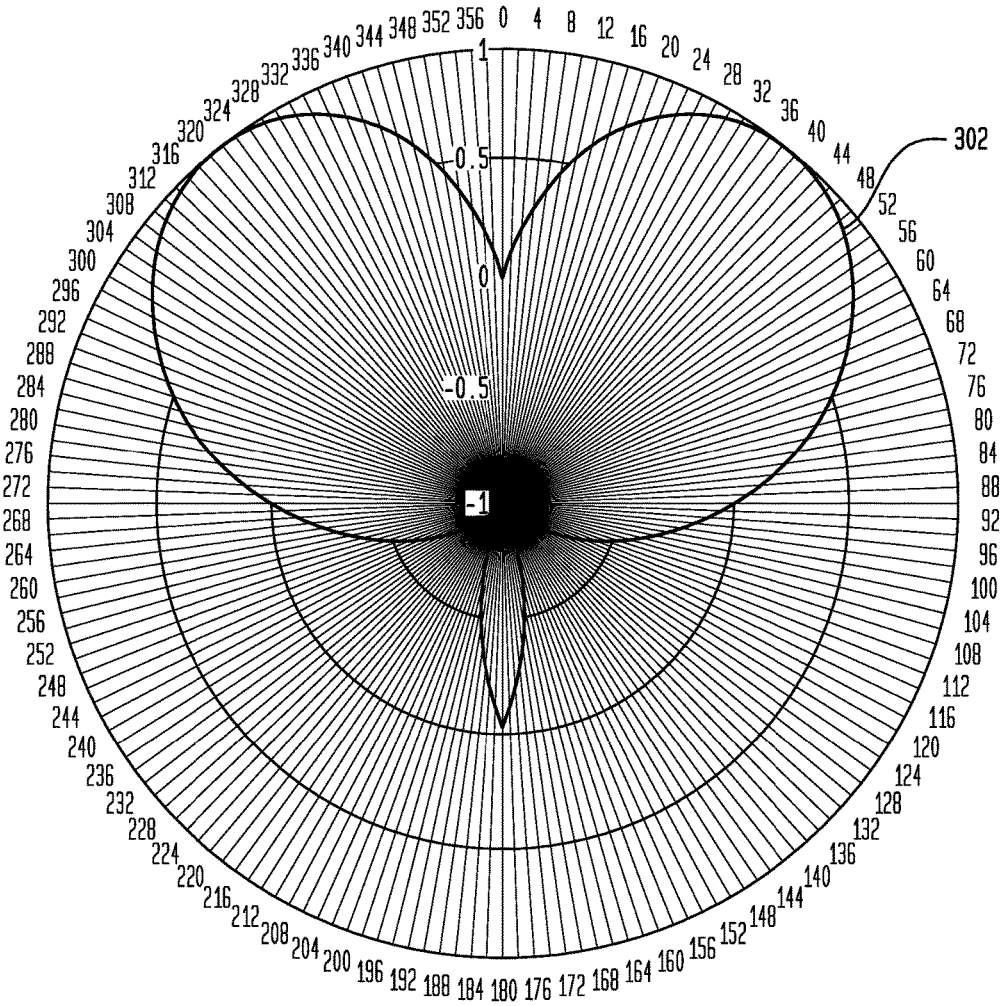

FIGS. 10A and 10B illustrate the free-field versions (i.e., without the effects of the head shadow) of cardioid patterns/signals that may be utilized in further embodiments presented herein. The cardioid pattern 300 of FIG. 10A may be generated, for example by convolving the cardioid pattern 278 of FIG. 6D with a frontal cardioid (or by performing multiplication in frequency domain). The cardioid pattern 302 of FIG. 10B may be generated, for example by convolving the cardioid pattern 278 of FIG. 6D subtracted by the backward cardioid 276 of FIG. 10C.

As noted, FIGS. 10A and 10B illustrate free-field results. In practice, the patterns of FIGS. 10A and 10B would be modified to account for the shadowing and reflecting of sounds by a recipient's head.

In general, the arrangements of FIGS. 6A-10B illustrate the cardioid patterns/signals (i.e., device sensitivities) that are "complementary to" the functional ear 105. That is, the cardioid patterns/signals generated in the arrangements of FIGS. 6A-10B do not significantly overlap with the hearing of the contralateral functional ear 105

In accordance with certain examples presented herein, a device fitting process may be implemented where a particular type of bone conduction device is calibrated for optimal use of the techniques presented herein. For example, the placement of the microphones differs between different types of device and the type of attachment towards the skull also varies (e.g., soft band, abutment, magnets, etc.). It is therefore the case that the side-beamforming techniques may make use of different settings depending, for example, on where the microphones are located, how the device is worn by a recipient, etc.

As noted above, for ease of illustration, the techniques presented herein have been primarily described with reference to the use of bone conduction devices to treat recipients suffering from single-sided deafness. However, it is to be appreciated that the techniques presented herein may also be used in a variety of other hearing prostheses.

For example, the techniques presented herein may be also be used in a hearing aid having a plurality of microphones located at a recipient's deaf ear and a stimulation unit (e.g., receiver configured to deliver acoustic signals to the contralateral functional ear) located at the recipient's functional ear. The hearing may include a sound processor and other components located at the deaf ear or functional ear. The components at the deaf ear and contralateral ear may be connected via a wired or wireless connection.

In one embodiment, a method performed at a hearing prosthesis worn by a recipient is provided. The method comprises monitoring a spatial region proximate to a first ear of the recipient for a sound, wherein the spatial region is a head shadow region of a second ear of the recipient; detecting the sound within the spatial region; and presenting the sound to the recipient via the hearing prosthesis. In one example, presenting the sound to the recipient via the hearing prosthesis comprises applying a gain to the sound. In a further example, applying the gain to the sound comprises applying a gain to the sound that is proportionally related to an input level of the sound. In a still further example, applying the gain to the sound comprises determining whether the input level of the sound is greater than a threshold, and applying a gain to the sound only if the input level is greater than the threshold. In one example, the method performed at the hearing prosthesis worn by the recipient further comprises estimating the signal-to-noise ratio (SNR) of the sound and presenting the sound to the recipient via the hearing prosthesis only when the SNR estimate is greater than a threshold. In one example, a hearing ability of the first ear is less than the hearing ability of the second ear at one or more frequencies. In a further example, the first ear is one of partially deaf, substantially deaf, completely deaf, non-functional and/or absent.

In another embodiment, a hearing prosthesis is provided. The hearing prosthesis comprises two or more microphones configured to detect a sound signal at a first ear of a recipient having a second ear, a sound processor, and a stimulation unit. The sound processor is configured to determine whether the sound signal is detected within a spatial region having an angular width so as to substantially avoid overlap with hearing of the second ear of the recipient at a plurality of frequencies, and when the sound signal is detected within a spatial region, generate stimulation drive signals representative of the sound signal. The stimulation unit is configured to generate, based on the stimulation drive signals, stimulation signals configured to evoke perception of the sound signal at the second ear. In one example, the stimulation unit is a transducer configured to generate vibration that is delivered to the second ear via the recipient's skull. In another example, the stimulation unit is a receiver configured to deliver acoustic signals to the second ear of the recipient.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A method performed at a bone conduction device worn at a first ear of a recipient, the method comprising:

detecting a sound;

determining whether the sound is detected within a spatial region that is proximate to the first ear of the recipient and has an angular width so as to substantially avoid overlap with hearing of the second ear at selected frequencies, wherein the spatial region is a head shadow region of a second ear of the recipient;

when the sound is detected within the spatial region, processing the sound in accordance with a first set of settings to generate stimulation drive signals representative of the sound; and when the sound is detected outside of the spatial region, processing the sound in accordance with a second set of settings to prevent the generation of stimulation drive signals, wherein the second set of settings are different from the first set of settings.

2. The method of claim 1, wherein processing the sound in accordance with a first set of settings to generate stimulation drive signals representative of the sound comprises:

filtering the sound to remove frequency components below a frequency threshold; and generating the vibration based on only frequency components of the sound signal that have an associated frequency greater than the frequency threshold.

3. The method of claim 1, wherein processing the sound in accordance with a second set of settings to prevent the generation of stimulation drive signals comprises:

analyzing an input level of the sound; and when the input level is below a threshold, placing the bone conduction device in a low power state in which the bone conduction device does not present the detected sound to the recipient.

4. The method of claim 1, wherein the bone conduction device, when worn by the recipient, includes a front-facing omnidirectional microphone associated with a front facing cardioid and a rear-facing omnidirectional microphone associated with a rear facing cardioid.

5. The method of claim 4, wherein detecting the sound comprises:

detecting sounds with the front-facing omnidirectional microphone;

detecting sounds with the rear-facing omnidirectional microphone; and convolving the sounds detected with the front-facing omnidirectional microphone with the sounds detected with the rear-facing omnidirectional microphone.

6. The method of claim 4, wherein detecting the sound comprises:

detecting sounds with the front-facing omnidirectional microphone;

detecting sounds with the rear-facing omnidirectional microphone;

calculating a cross correlation between the front facing cardioid and the rear facing cardioid to generate a correlated signal; and using the correlated signal for presentation of the sound via the bone conduction device.

7. The method of claim 4, wherein detecting the sound comprises:

detecting sounds with the front-facing omnidirectional microphone;

detecting sounds with the rear-facing omnidirectional microphone;

identifying sounds found in both the front facing cardioid and the rear facing cardioid; and retaining only the sounds found in both the front facing cardioid and the rear facing cardioid.

8. A method, comprising:

detecting a sound with a pair of microphones of a bone conduction device;

determining whether the sound is detected within a spatial region that is proximate to a first ear of a recipient using the bone conduction device and has an angular width so as to substantially avoid overlap with hearing of the second ear at selected frequencies, wherein the bone conduction device comprises a pair of microphones and a signal processing path;

when the sound is detected in the spatial region, activating one or more side-beamforming audio settings to present the sound to the recipient via the bone conduction device; and when the sound is not detected in the spatial region, deactivating the bone conduction device so that the sound is not presented to the recipient via the bone conduction device.

9. The method of claim 8, wherein activating one or more side-beamforming audio settings comprises:

filtering the sound to remove frequency components below a threshold; and presenting to the recipient only frequency components of the sound that have an associated frequency greater than the threshold.

10. The method of claim 8, wherein activating one or more side-beamforming audio settings comprises:

applying a gain to the sound.

11. The method of claim 10, wherein applying gain to the sound comprises:

applying to the sound a gain that is proportionally related to an input level of the sound.

12. The method of claim 10, wherein applying gain to the sound comprises:

determining whether an input level of the sound is greater than a threshold; and applying a gain only when the sound has an associated input level that is greater than the threshold.

13. The method of claim 8, wherein activating one or more side-beamforming audio settings comprises:

estimating the signal-to-noise ratio (SNR) of the sound; and presenting the sound to the recipient via the bone conduction device only when the SNR estimate is greater than a threshold.

14. A bone conduction device configured to selectively operate in accordance with a first set of settings and a second set of settings, comprising:

two or more microphones configured to detect a sound signal at a first ear of a recipient having a second ear;

a sound processor configured to:

determine whether the sound signal is detected within a spatial region that is proximate to the first ear and that has an angular width so as to substantially avoid overlap with hearing of the second ear of the recipient at a plurality of frequencies, and process the sound signal in accordance with the first set of settings when the sound signal is detected within the spatial region to generate stimulation drive signals representative of the sound signal and to process the sound signal in accordance with the second set of settings when the sound signal is detected outside of the spatial region to prevent the generation of stimulation drive signals, wherein the second set of settings are different from the first set of settings; and a stimulation unit configured to generate, based on the stimulation drive signals generated using the first set of settings, stimulation signals configured to evoke perception of the sound signal at the second ear.

15. The bone conduction device of claim 14, wherein to process the sound signal in accordance with the first set of settings, the sound processor is configured to:

filter the sound detected within the spatial region to remove frequency components below a threshold; and generate stimulation drive signals representative of only frequency components of the sound that have an associated frequency greater than the threshold.

16. The bone conduction device of claim 14, wherein to process the sound signal in accordance with the first set of settings, the sound processor is configured to:

apply a gain to the sound signal detected within the spatial region.

17. The bone conduction device of claim 16, wherein to apply gain to the sound signal detected within the spatial region, the sound processor is configured to:

apply a gain to the sound signal that is proportionally related to an input level of the sound signal.

18. The bone conduction device of claim 16, wherein to apply gain to the sound signal detected within the spatial region, the sound processor is configured to:

determine whether an input level of the sound signal detected within the spatial region is greater than a threshold; and applying a gain only when the sound signal has an associated input level that is greater than the threshold.

19. The bone conduction device of claim 14, wherein the two or more microphones comprise a front-facing omnidirectional microphone associated with a front facing cardioid and a rear-facing omnidirectional microphone associated with a rear facing cardioid, and wherein to determine whether the sound signal is detected within the spatial region that is proximate to the first ear and that has an angular width so as to substantially avoid overlap with hearing of the second ear of the recipient at a plurality of frequencies, the sound processor is configured to:

determine whether the sound signal is found in both the front and rear facing cardioids, wherein the sound signal is detected within a spatial region only when the sound signal is found in both the front and rear facing cardioids.

* * * * *